United States Patent [19]

Hikake et al.

[11] Patent Number: 4,900,647

[45] Date of Patent: Feb. 13, 1990

[54] PROCESS FOR PRODUCING ELECTROPHOTOGRAPHIC TONER COMPRISING MICROPULVERIZATION, CLASSIFICATION AND SMOOTHING

[75] Inventors: Norio Hikake; Hitoshi Kanda, both of Yokohama; Yoshihiko Hyosu, Machida, all of Japan

[73] Assignee: Canon Kabushiki Kaisha, Tokyo, Japan

[21] Appl. No.: 174,895

[22] Filed: Mar. 29, 1988

[30] Foreign Application Priority Data

Mar. 31, 1987 [JP] Japan ..... 62-78016

[51] Int. Cl.[4] ..... G03G 9/08

[52] U.S. Cl. ..... 430/137; 430/138; 264/15

[58] Field of Search ..... 430/137, 138; 264/15

[56] References Cited

U.S. PATENT DOCUMENTS 4,233,387 11/1980 Mammino ..... 430/137
4,837,107 6/1989 Axelsson et al. ..... 430/138

FOREIGN PATENT DOCUMENTS 2112538 7/1983 United Kingdom .

*Primary Examiner*—J. David Welsh
*Attorney, Agent, or Firm*—Fitzpatrick, Cella, Harper & Scinto

[57] ABSTRACT

A toner for producing electrostatic latent images is produced by smoothing classified resinous particles so that the ratio of the smallest diameter to the largest diameter thereof is 0.70–0.90, mixing the smoothed base particles (A) with modifier particles (B) to attach the modifier particles (B) to the surfaces of the base particles (A), and fixing the modifier particles (B) to the base particles (A) under the action of a mechanical impact force.

20 Claims, 8 Drawing Sheets

PROCESS FOR PRODUCING ELECTROPHOTOGRAPHIC TONER COMPRISING MICROPULVERIZATION, CLASSIFICATION AND SMOOTHING

FIELD OF THE INVENTION AND RELATED ART

The present invention relates to a process for producing a toner used in image forming processes such as electrophotography, electrographic recording and electrostatic printing.

Hitherto, toners having a predetermined particle size have generally been produced by melt-kneading mixed powders comprising a binder resin, a charge control agent, a release agent and a colorant by means of a machine such as kneader and extruder, pulverizing the kneaded product by means of a pulverizer, and removing coarse and fine powders, which can impair image quality, by means of a classifier. However, the surface conditions of such toner particles, which are most important for the quality of a toner image, are determined by the cleavage fractures of the resultant particles in the pulverization. Therefore, it has been difficult to control the surface conditions of the toner, and there have been posed various problems.

It is essentially preferred that the charge control agent is present in the vicinity of the toner surface. However, in the above-mentioned conventional pulverization process, a large amount of charge control agent must be added to a toner in order to obtain such effect, whereby there have been posed some problems in the production cost and the toner performance.

In order to solve the above-mentioned problems, it has been proposed that toner particles are coated with a powdery material by using a solvent and that a wall material is attached or applied to the surfaces of toner particles by heating, as disclosed in Japanese Laid-Open Patent Application (JP-A, Kokai) Nos. 106554/1983 and 210368/1986. However, in these methods, it has been difficult to prevent the agglomeration or aggregation of the base toner particles due to the solvent or heat. Further, the wall particles are also liable to agglomerate under such conditions, whereby it has been difficult to uniformly coat the toner particles with the wall material.

As a new method for solving these problems, there has been proposed a dry coating process for coating a base material with a modifier material, as disclosed in Funtai Kogaku Kaisha (Journal of the Society of Powder Technology, Japan) Vol. 24, No. 1, pp. 18–23 (1987). In this method, the base and modifier materials are pretreated by uniformly dispersing them by means of a mixer having dispersing ability, and then the modifier material is fixed to the base material under the action of an impact force.

However, when this new method as such is applied to the production of a toner for developing electrostatic images, there cannot be obtained a toner capable of providing good images. More specifically, a toner is powder such that the surface conditions thereof closely relate to the image quality obtained by using it, and the presence of an impurity considerably impairs the image quality. Therefore, when pulverized particles, which have irregular shapes and many convexities and concavities on their surfaces, are as such used as the base particles, an impact force is intensively exerted on the surface convexities whereby the coating of the modifier material is broken and the base material is exposed. Further, since the fixing of the coating becomes incomplete at the above-mentioned surface concavities, a toner capable of providing good images cannot be obtained.

The pulverization process for pulverizing a binder resin or a binder resin composition to produce base particles, while having the above-mentioned problems, can reduce the production cost and can easily provide base particles having a uniform composition. Therefore, in a practical industrial production process, it is extremely important to use base particles obtained by pulverization. Accordingly, there has been desired a process wherein an excellent toner for developing electrostatic images may be produced by using the base particles obtained by pulverization.

SUMMARY OF THE INVENTION

An object of the present invention is to provide a process for producing a toner for developing electrostatic images, wherein the above-mentioned various problems found in the prior art are overcome.

Another object of the present invention is to provide a toner wherein modifier particles are surely fixed to base particles without ill effect due to primary or agglomerate particles such as those of the modifier particles, or due to an adhesion product of fine toner powder and the modifier particles.

A further object of the present invention is to provide a process for producing an electrostatic image-developing toner having a low cost and high quality.

According to the present invention, there is provided a process for producing a toner for developing electrostatic latent images comprising: pulverizing a resinous material comprising at least a binder resin by a micropulverizing means thereby to prepare resinous particles; classifying the resinous particles by a classifying means thereby to obtain classified particles having a predetermined particle size; smoothing the classified particles to prepare base particles (A) having a ratio of the smallest diameter to the largest diameter thereof of 0.70–0.90; mixing the base particles (A) with modifier particles (B), thereby to attach the modifier particles (B) to the surfaces of the base-particles (A); and fixing the modifier particles (B) to the surfaces of the base particles (A) under the action of a mechanical impact force.

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 1:
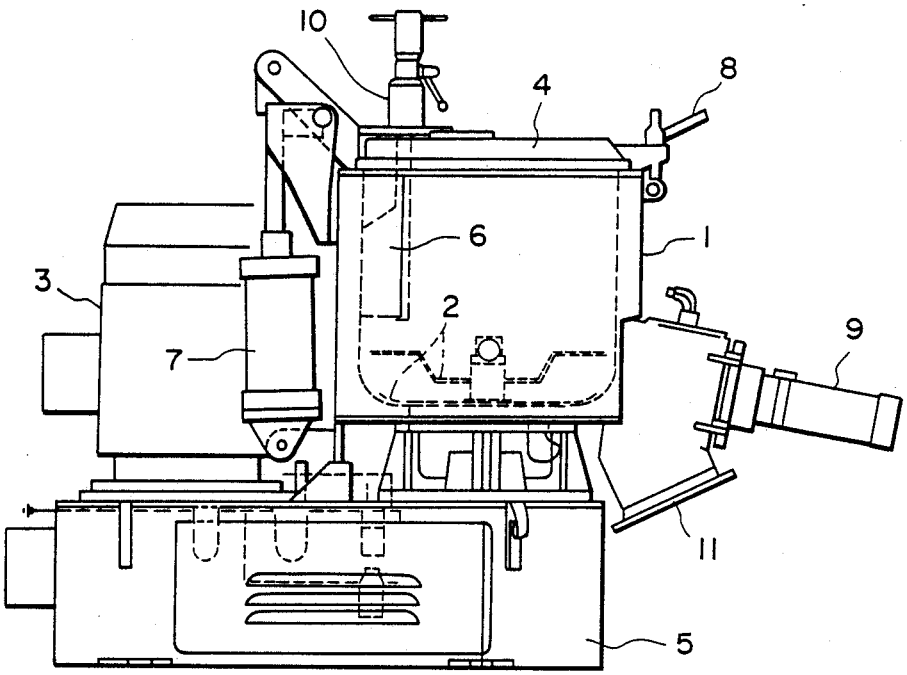
FIG. 1 is a schematic sectional view showing an embodiment of a stirring device for pretreating base particles (A) and modifier particles (B)

In the present invention, a composition constituting a base material which comprises a binder resin and an additive such as a pigment is melt-kneaded by heating, the resultant melt-kneaded product is micro-pulverized by means of a micro-pulverizer thereby to obtain a pulverized product, and the particle size of the pulverized product is adjusted by means of a classifier. Alternatively, the pulverized product may be obtained by micro-pulverizing a binder resin as such. The thus prepared classified product (powder) is then smoothed, (i.e., the surface inequalities or irregularities of the pulverized product are removed) thereby to prepare powder as base particles (A).

In the present invention, the classified base particles are smoothed so that the ratio of the smallest diameter to the largest diameter thereof may be 0.70–0.90, preferably 0.75–0.90. Herein, the largest diameter is the largest particle size of a particle and the smallest diameter is the smallest particle size of the particle.

The above-mentioned largest and smallest diameters are determined in the following manner.

About 100 particles are randomly selected from a photograph (magnification: 1,000–3,000) of the particles taken with an electron microscope (scanning-type). The largest and smallest diameters of the thus selected individual 100 particles are measured and averaged thereby to determine the above-mentioned largest and smallest diameters. Ordinarily, unsmoothed pulverized powder shows a ratio of the smallest diameter to the largest diameter of below 0.7.

Such smoothing step may be conducted simultaneously with the pulverization step. The pulverization may preferably be conducted under the action of an impact force corresponding to a peripheral speed of 100 m/sec–160 m/sec (at the tip of a rotating member (e.g., blade) of an impact-type pulverizer), at an ambient temperature of 10°–60° C. in a pulverization chamber to obtain particles having a prescribed particle size corresponding to a toner. Thereafter, the particle size may be adjusted by means of a classifier.

The thus obtained base particles are pretreated by uniformly dispersing modifier particles therein, and then the modifier particles are fixed to the base particles by means of a device for fixing treatment under the action of an impact force thereby to obtain a toner for developing electrostatic images.

In the step of smoothing the base particles, there may be used the following methods: a method wherein the base particles are heat-treated; a method wherein the base particles are rounded by means of a jet mill under a reduced pulverization pressure of 2–3 kg/cm$^2$; a method wherein an impact-type pulverizer is used; and a method wherein the base particles are treated in a medium such as a vibration mill.

In a case where the impact-type pulverizer is used in the smoothing step, there may generally be used an impact force smaller than that used in mechanical pulverization, in order to prevent the production of fine powder due to the progress in pulverization. More specifically, in a case where a resin for a toner is used, the base particles may preferably be smoothed at a peripheral speed of about 60 m/sec–130 m/sec which is at least 10 m/sec smaller than that in the pulverization step, while depending on the pulverizability of the resin. Further, the base particles may preferably be smoothed at a peripheral speed of 1.1–2 times, more preferably 1.4–1.8 times that used in the fixing step.

The base particles may be prepared by pulverizing a resin as such comprising a binder component; or by melt-kneading a mixture comprising a binder resin and an additive such as a pigment, a charge control agent and a release agent, by means of a machine such as an extruder or kneader, cooling and solidifying the kneaded product, and pulverizing the solidified product. The thus prepared pulverized product may be classified by means of a classifier to adjust the particle size whereby there is obtained a classified product preferably having a ratio of the smallest diameter to the largest diameter of 0.60 or more and below 0.70. The classified product is then smoothed thereby to obtain base particles used in the present invention having a ratio of the smallest diameter to the largest diameter of 0.70–0.90, preferably 0.75–0.90.

In the present invention, the fixing process comprises a pretreatment step wherein modifier particles are dispersed in the base particles to uniformly attach the modifier particles to the base particles, and a fixing step wherein the attached modifier particles are fixed to the base particles under the action of an impact force.

In the pretreatment step, the modifier particles, while dispersed in the base particles, are rubbed therewith whereby the modifier particles are attached to the base particles under the action of an electrostatic force. In this step, e.g., a mixer having a stirring vane rotatable at a high speed may preferably be used, but a mixer used in this step is not restricted thereto. More specifically, another mixer may be used as far as it has a mixing function and a dispersing function.

FIG. 1 shows an embodiment of a mixer (Henschel mixer) having a high-speed stirring vane. The mixer shown in FIG. 1 comprises a jacket 1, a stirring vane 2, a motor 3 for driving the stirring vane, a lid 4, a base 5, a control plate 6 for collision with powder, a cylinder 7 for lifting the lid, a locking device for the lid, a cylinder 9, a direction control unit 10 for changing the angle of the control plate, and a discharge port 11.

In the pretreatment, it is required that both the base particles and the modifier particles are sufficiently dispersed, that the base particles are not substantially pulverized and that the modifier particles are not partially fixed to the base particles in this step. Thus, the conditions of the pretreatment may be determined depending on the physical property of the base particle material, but the following conditions may generally preferably be used in case of a material for toner: a treatment temperature (ambient temperature) of 0°-50° C. more preferably 10°-40° C., which is preferably lower than the softening point of the base particles and the modifier particles; a peripheral speed at the tip of a stirring vane of 5-50 m/sec; a treatment time of 10 sec-24 hours, more preferably 1 min-1 hour; the length of a stirring vane of 10-100 cm, which is preferable in view of mixing efficiency and the prevention of the pulverization. Further, in this treatment, the treatment chamber may preferably be cooled by means of a jacket or cooling air.

As the device for the pretreatment, in addition to the above-mentioned mixer having a high-speed stirring vane, there may be used a device which has a dispersing and a mixing function and can provide a sufficiently long residence time. More specifically, there may be used a machine such as a pulverizer, a vibration mill, and a ball mill, by reducing the impact force thereof so as to satisfy the above-mentioned conditions. Further, the modifier particles may be dispersed in a liquid containing base particles, and then the resultant mixture may be subjected to filtration, drying and fixing.

Then, a method of fixing will be described.

In a toner, it is not preferred that the fragments of the base particles or the modifier particles are freed, or that the modifier particles once attached to the base particles are again freed therefrom even in a very small amount. Therefore, it is preferred that the modifier particles are surely fixed to the base particles. In a case where a pulverizer is used, it is important to modify the pulverizer so that the powder to be treated may have a longer residence time in the portion thereof corresponding to a pulverization step. Further, it is also important to control the impact force so that the base particles are not substantially pulverized, and to control the temperature so that the fusion thereof does not substantially occur.

Figure 2A:
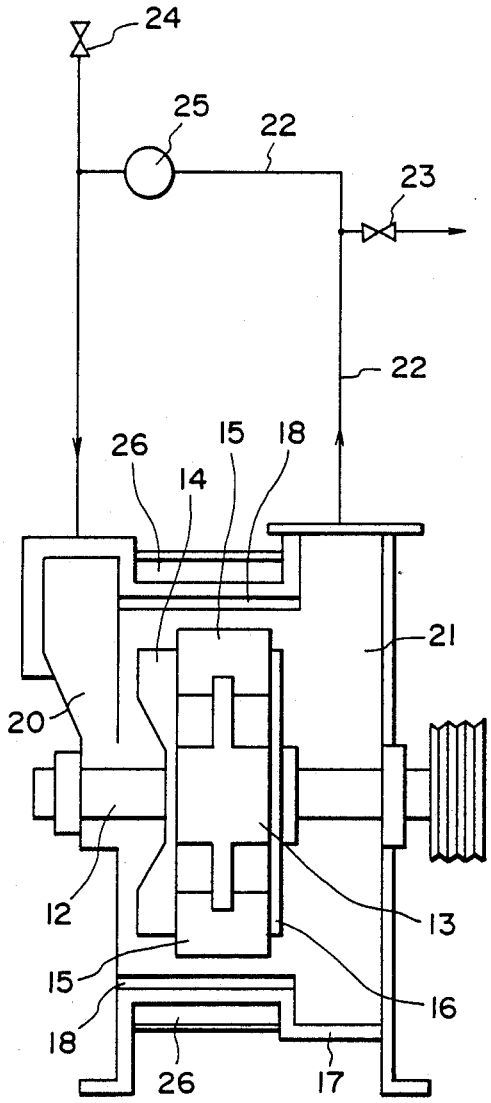
FIG. 2A is a schematic sectional view showing an embodiment of a device for fixing the modifier particles (B) to the base particles (A)
Figure 3A:
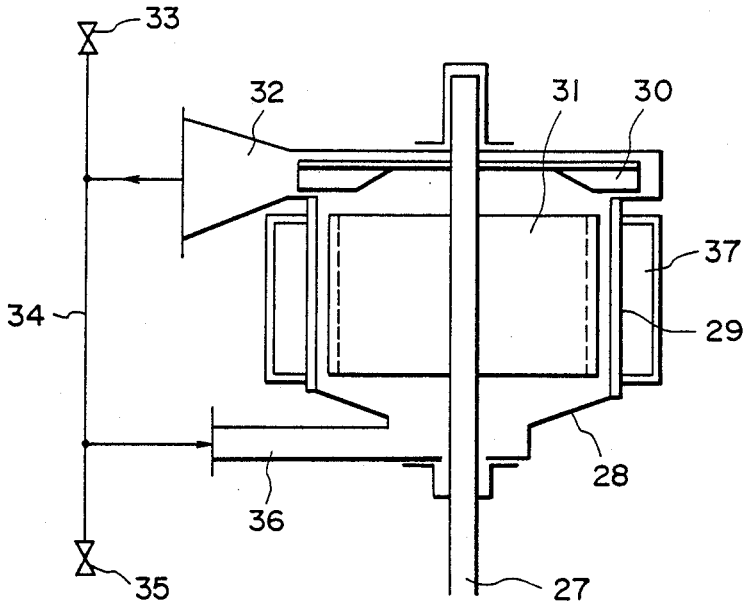
FIG. 3A is a schematic sectional view showing another embodiment of a device for fixing the modifier particles (B) to the base particles (A)
Figure 4A:
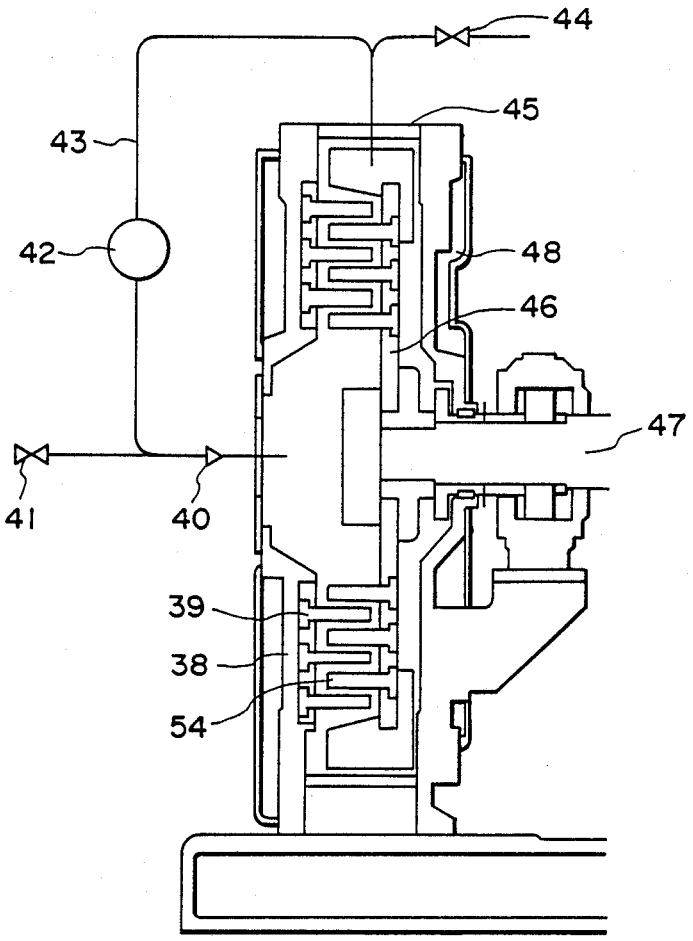
FIG. 4A is a schematic sectional view showing an embodiment of a pin mill-type device for fixing the modifier particles (B) to the base particles (A)

For example, there may effectively be used: a pin mill as shown in FIG. 4A which has a recycling function and has a large number of rotating pins; or a pulverizer as shown in FIG. 2A or 3A which has a recycling mechanism and in which an impact force is provided between a liner and a rotating blade or hammer.

The fixing step may preferably be conducted at a peripheral speed of 30-150 m/sec, more preferably 30-130 m/sec, further preferably 30-100 m/sec, at the tip of the blade or hammer. The temperature in the fixing step may preferably be 10° C.-100° C., more preferably 20° C.-100° C., further preferably 30° C.-70° C. while it varies depending on the physical property of the base particles or modifier particles. Further, the temperature in the treatment chamber may preferably be at least 20° C. lower than the softening point of the base particles (A). Further, the residence time of the base particles and the modifier particles in the portion in which an impact force is applied thereto may preferably be 0.2 sec-12 sec.

In a case where the pin mill is used, it is required to increase the powder density. However, in the type of a machine as shown in FIG. 2A or 3A, more latitude in the density may be allowed because the powder to be treated is gathered into the vicinity of the liner under the action of a centrifugal force.

Figure 2B:
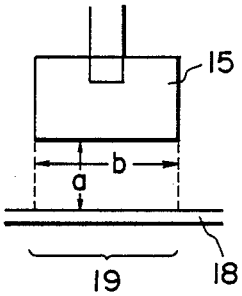
FIG. 2B is an enlarged schematic sectional view showing a part of the device shown in FIG. 2A.

The device shown in FIGS. 2A and 2B comprises a rotation axis 12, a rotor 13, a dispersing vane 14, a rotating member (blade) 15, a partition circular plate 16, a casing 17, a liner (fixed member) 18, an impact zone 19 (FIG. 2B), an inlet chamber 20, an outlet chamber 21, a return conduit 22, an outlet valve 23 for a product, an intake valve 24 for a feed material, a blower 25, and a jacket 26.

Figure 8:
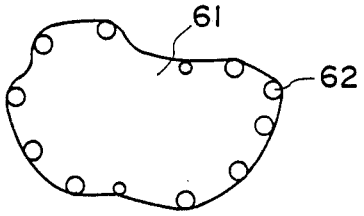
FIG. 8 is a schematic sectional view showing a toner particle obtained in the present invention.

More specifically, referring to FIG. 2A, the base particles to which the modifier particles are attached are supplied through the inlet 24, passed through the inlet chamber 20, and then passed through the impact zone 19 between the liner 18 and the blade 15 which rotates along the rotating dispersing vane 14. Thereafter, the base particles are passed through the outlet chamber 21, the return conduit 22 and the blower 25, and again recycled in such circuit. After the completion of the fixing treatment, the base plates 61 comprising the modifier particles 62 and having a form as shown in FIG. 8 are discharged through the outlet 23 for the product.

In FIG. 2B, the clearance a between the rotating member (blade) 15 and the liner 18 is a minimum clearance, and the space corresponding to the width b of the rotating blade 15 is the impact zone. The width b may preferably be 10-1,000 mm. Further, the distance from the tip of a blade 15 on one side to that of the blade 15 on the opposite side (i.e., the distance from the tip of the upper blade 15 to that of the lower blade 15, as shown in FIG. 2A) may preferably be 100-1,000 mm in view of fixing efficiency.

Figure 3B:
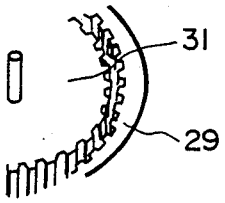
FIGS. 3B and 3C are enlarged schematic views each showing a part of the device shown in FIG. 3A.
Figure 3C:
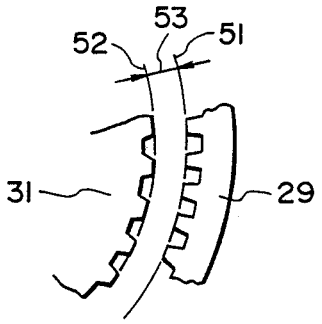

On the other hand, a device for fixing treatment as shown in FIGS. 3A, 3B and 3C comprises a rotation axis 27, a casing 28, a liner 29, a blower vane 30, a rotor 31 having a blade, an outlet port 32, a feed material supply port 33, a return conduit 34, an outlet 35 for a product, an inlet port 36, and a jacket 37.

FIG. 3C shows a positional relationship between the liner 29 and the rotating rotor 31 in the fixing device shown in FIG. 3A. The minimum clearance 53 between the liner 29 and the rotor 31 is the difference in radius between two kinds of circles, i.e., a circle 51 obtained by connecting the tip points of the protrusions of the liner 29 protruding toward the inside of the device; and a circle 52 traced by the point on the periphery of the protrusion of the rotor 31. This minimum clearance 53 may be determined in the same manner as described above, in a case where a blade or a hammer is used instead of the rotor 31.

Figure 4B:
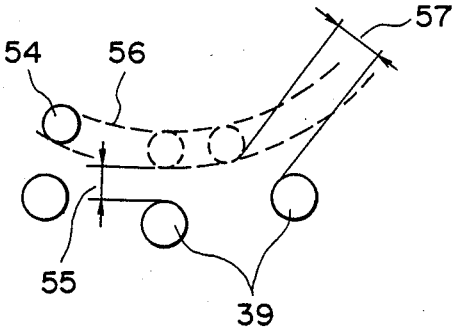
FIG. 4B is an enlarged schematic sectional view showing a part of the device shown in FIG. 4A.

Further, a pin mill-type device for fixing treatment as shown in FIGS. 4A and 4B comprises a casing 38, a fixed pin 39, an inlet port 40, a feed material supply port 41, a recycling blower 42, a return conduit 43, an outlet 44 for a product, an outlet port 45, a rotor 46, a rotation axis 47, a jacket 48, and a rotating pin 54.

FIG. 4B shows a schematic view of the pins in the pin mill-type fixing device as viewed from the front direction of the device. In FIG. 4B, the clearance 55 between the fixed pin 39 and the rotating pin 54 is a minimum clearance. Incidentally, reference numeral 57 denotes a maximum clearance between the fixed pin 39 and the rotating pin 54, and numeral 56 denotes a circle traced by the rotating pin 54.

The clearance between the pins of the pin mill or the clearance between the liner and the blade or hammer may preferably be about 0.5-5 mm, more preferably 1 mm-3 mm in order to obtain more desirable results. In case of the pin mill, a preferred result may be obtained by adjusting the minimum clearance between the pins to 0.5-5 mm and adjusting the maximum clearance to 10 mm or below, more preferably 5 mm or below.

In the above-mentioned FIGS. 2B, 3C and 4B, an impact force is applied to a mixture of the base particles and the modifier particles between a moving member (such as a rotating member) and a fixed member. In the present invention, such impact force may also be applied to the mixture between at least two moving members such as rotating members.

In some cases, the thus obtained toner can contain a small amount of an agglomerate of the modifier particles, or an adhesion product of fine base particles having a particle size of 5 μm or below and the modifier particles. In such case, while depending on a matching of the toner with a photosensitive member or a copying machine, these impurities can sometimes cause fog or a white streak in an image, or invite a decrease in the image density in successive copying of a large number of sheets. These phenomena are sometimes unacceptable.

Therefore, in order to further enhance the image quality, a classification step may be conducted after the fixing step thereby to remove coarse powder and/or fine powder. In this classification step, various types of classifiers can be used, but there may preferably be used a centrifugal classifier-type machine using a rotating vane having a dispersing ability, or a fixed wall-type centrifugal classifier. Particularly, there may preferably be used a classifier having a Coanda block and utilizing a Coanda effect, as disclosed in U.S. Pat. No. 4,132,634.

Incidentally, in the process according to the present invention, a relatively small amount of modifier particles may be used and attached to a part of the surfaces of toner particles, not to entire surfaces thereof, and fixed to thereto. In such an embodiment, there may be improved the quality of an image formed by the toner, the anti-offset characteristic of the toner in fixation or the anti-winding characteristic thereof to a fixation roller.

Examples of the binder resin to be used in the base particles may include: homopolymers of styrene and derivatives thereof such as polystyrene, poly(p-chlorostyrene), and polyvinyltoluene; styrene copolymers such as styrene-p-chlorostyrene copolymer, styrene-vinyltoluene copolymer, styrene-vinyl-naphthalene copolymer, styrene-acrylic acid ester copolymer, styrene-methacrylic acid ester copolymer, styrene-methyl α-chloromethacrylate copolymer, styrene-acrylonitrile copolymer, styrene-vinyl methyl ether copolymer, styrene-vinyl ethyl ether copolymer, styrene-vinyl methyl ketone copolymer, styrene-butadiene copolymer, styrene-isoprene copolymer, and styrene-acrylonitrile-indene copolymer; polyvinyl chloride, phenolic resins, natural resin-modified phenolic resins, natural resin-modified maleic acid resins, acrylic resins, methacrylic resins, polyvinyl acetate, silicone resins polyester resins, polyurethanes, polyamide resins, fûran resins, epoxy resins, xylene resins, polyvinyl butyral, terpene resin, coumarone-indene resins, and petroleum resin. These binder resins may be used either singly or as a mixture.

In the present invention, the binder resin may preferably have a softening point measured by the following method of 90°-150° C., more preferably 90°-140° C., in view of the fixing step and the developing characteristics of a tone.

Flow Tester Model CFT-500 (available from Shimazu Seisakusho K.K.) is used. Powder having passed through a 60-mesh sieve is used as a sample and weighed as about 1.0 to 1.5 g. The sample is pressed under a pressure of 100 kg/cm$^2$ for 1 minute by using a tablet shaper.

The pressed sample is subjected to measurement by means of Flow Tester under the following conditions:

| | |
|---|---|
| RATE TEMP | 6.0 D/M (°C./min) |
| SET TEMP | 50.0 DEG (°C.) |
| MAX TEMP | 200.0 DEG |
| INTERVAL | 2.5 DEG |
| PREHEAT | 300.0 SEC |
| LOAD | 20.0 KGF (kg) |
| DIE (DIA) | 0.5 MM (mm) |
| DIE (LENG) | 1.0 MM |
| PLUNGER | 1.0 CM$^2$ (cm$^2$) |

From the above measurement, the softening temperature of the sample is defined as the temperature corresponding to ½ of the stroke difference (of the piston placed on the sample) of from the resultant flow-initiation temperature to the flow-termination temperature of the sample.

In the present invention, there may preferably be used a crosslinked styrene copolymer or polyester. Examples of comonomers to be copolymerized in the above-mentioned styrene copolymer include: monocarboxylic acids having a double bond or derivatives thereof such as acrylic acid, methyl acrylate, ethyl acrylate, butyl acrylate, dodecyl acrylate, octyl acrylate 2-ethylhexyl acrylate, phenyl acrylate, methacrylic acid,methyl methacrylate, ethyl methacrylate, butyl methacrylate, octyl methacrylate, acrylonitrile, methacrylonitrile, and acrylamide; dicarboxylic acids having a double bond or derivatives thereof such as maleic acid, butyl maleate, methyl maleate and dimethyl maleate.

Further, there may mainly be used a compound having two or more polymerizable double bonds, as the crosslinking agent. Examples of such crosslinking agent may include: aromatic divinyl compounds such as divinylbenzene and divinylnaphthalane carboxylic acid esters having two double bonds such as ethylene glycol diacrylate, ethylene glycol dimethacrylate, and 1,3-butanediol dimethacrylate; divinyl compounds such as divinylaniline, divinyl ether, divinyl sulfide and divinyl sulfone; and compounds having 3 or more vinyl groups. These compounds may be used singly or as a mixture.

The colorant may be known dyes or pigments such as carbon black or grafted carbon black obtained by coating the surface of carbon black with a resin. These colorants may be used either singly or in a mixture of two or more species, as desired. The colorant may be contained in a proportion of 0.5-30 wt. % based on the amount of the polymer and a low-melting point compound as described below.

In order to produce a magnetic toner, magnetic particles are added thereto. In this case, the magnetic particles also function as a colorant partially or entirely. The magnetic particles usable in the present invention may be a substance magnetizable when placed in a magnetic field, such as powder of a ferromagnetic metal such as iron, cobalt and nickel, an alloy thereof, or compound thereof such as magnetite, hematite and ferrite. The magnetic particles may have a particle size of 0.05-5μ, preferably 0.1-1μ. The amount of the magnetic particles may suitably be 10-60 wt. %, more preferably 20-50 wt. %, based on the toner weight. It is possible that the magnetic particles have been treated with a treating agent such as silane coupling agent or titanate coupling agent or with an appropriate reactive resin. In this case, while also depending on the surface area of the magnetic particles or the density of the hydroxyl group present at the surface thereof, a treating amount of 5 wt. % or less, preferably 0.1–3 wt. % based on the weight of the magnetic particles may provide a sufficient dispersibility in the toner.

The charge control agent or charge controller used in the present invention may be positive or negative charge controllers conventionally known in the art. Examples thereof may include those as follows:

(1) Substances controlling a toner to be positively chargeable:

nigrosin; azine dyes having an alkyl group containing 2–16 carbon atoms (as disclosed in Japanese Patent Publication (JP-B, Kokoku) No. 1627/1967); basic dyes including, e.g., C.I. Basic Yellow 2 (C.I. 41000), C.I. Basic Yellow 3, C.I. Basic Red 1 (C.I. 45160), C.I. Basic Red 9 (C.I. 42500), C.I. Basic Violet 1 (C.I. 42535), C.I. Basic Violet 3 (C.I. 42555), C.I. Basic Violet 10 (C.I. 45170), C.I. Basic Violet 14 (C.I. 42510), C.I. Basic Blue 1 (C.I. 42025), C.I. Basic Blue 3 (C.I. 51005), C.I. Basic Blue 5 (C.I. 42140), C.I. Basic Blue 7 (C.I. 42595), C.I. Basic Blue 9 (C.I. 52015), C.I. Basic Blue 24 (C.I. 52030), C.I. Basic Blue 25 (C.I. 52025), C.I. Basic Blue 26 (C.I. 44045), C.I. Basic Green 1 (C.I. 42040), C.I. Basic Green 4 (C.I. 42000); lake pigments of these basic dyes (agents for producing these lake pigments may include phosphorus wolframic acids, phosphorus molybdic acids, phosphorus wolframic molybdic acid, tannic acid, lauric acid, gallic acid, ferricyanides, ferrocyanides); C.I. Solvent Black 3 (C.I. 26150), Hansa Yellow G (C.I. 11680), C.I. Mordant Black 11, C.I. Pigment Black 1, benzylmethylhexadecylammonium chloride and decyl-trimethylammonium chloride; dialkyl in compounds having groups such as dibutyl and dioctyl higher fatty acid metal salts; metal complex compounds of acetylacetone; vinyl polymers having an amino group; polyamine resins such as condensation-polymerized polymer having an amino group.

(2) Substances controlling a toner to be negatively chargeable:

metal complex compounds of monoazo dyes as disclosed in Japanese Patent Publication (Kokoku) Nos. 20153/1966, 27596/1968, 5397/1969, 26478/1970;

nitrohumic acid and its salts as disclosed in Japanese Laid-Open Patent Application (Kokai) No. 133338/1975; and dyes or pigments such as C.I. 14645;

metal complex compounds containing a Zn, Al, Co, Cr or Fe atom and salicylic acid, naphthoic acid or dicarboxylic acids; and sulfonated copper phthalocyanine pigments.

In a case where the charge control agent is contained in the base particles, the charge control agent may preferably be used in an amount of 0.1–10 wt. parts, per 100 wt. parts of the binder resin. On the other hand, in a case where the charge control agent is contained in the modifier particles, the charge control agent may preferably be used in an amount of 1–50 wt. %, more preferably 1–20 wt. %, based on the weight of the modifier particles.

In the base particle, a release agent having a releasing characteristic may be contained.

In a case where the release agent is contained in the base particles, the release agent may preferably be contained in an amount of 0.1–10 wt. parts, per 100 wt. parts of the binder resin.

Examples of the release agent may include those as described below, but are not restricted thereto. The release agent may preferably have a softening point measured according to the ring and ball method (as described in JIS K 2531) of 40–130° C., more preferably 50–120° C. If the softening point is below 40° C., the anti-blocking property and the shape-retaining property of the toner become insufficient.

On the other hand, if the softening point is above 130° C., the effect is reducing a fixing temperature or a fixing pressure is a little.

Examples of such low-softening point compound include paraffin waxes, low-molecular weight polyolefins, modified waxes having an aromatic group, hydrocarbon compounds having an alicyclic group, natural waxes, long-chain carboxylic acids having a long hydrocarbon chain ($CH_3$—$CH_2)_{11}$ or —$CH_2)_{12}$ or a longer aliphatic chain) including 12 or more carbon atoms, esters and metal salts thereof fatty acid amides and fatty acid bisamides. A mixture of different low-softening point compouds may be used. More specifically, examples of commercially available products include Paraffin Wax (Nihon Sekiyu K.K.), Paraffin Wax (Nihon Seiro K.K.), Microwax (Nihon Sekiyu K.K.), Microcrystalline Wax (Nihon Seiro K.K.), Hard Paraffin Wax (Nihon Seiro K.K.), PE-130 (Hoechst), Mitsui Hi-Wax 110P (Mitsui Sekiyu Kagaku K.K.), Mitsui Hi-Wax 220P (ditto), Mitsui Hi-Wax 660P (ditto), Mitsui Hi-Wax 210P (ditto), Mitsui Hi-Wax 320P (ditto), Mitsui Hi-Wax 410P (ditto), Mitsui Hi-Wax 420P (ditto), modified Wax JC-1141 (ditto), Modified Wax JC-2130 (ditto), Modified Wax JC-4020 (ditto), Modified Wax JC-1142 (ditto), Modified Wax JC-5020 (ditto); bees wax, carnauba wax, and montan wax.

On the other hand, examples of the fatty acid metal salt may include: zinc stearate, calcium stearate, magnesium stearate, zinc oleate, zinc palmitate, and magnesium palmitate.

In the present invention, the base particles may preferably have a volume-average particle size of 30 μm or below, more preferably 2–20 μm. The base particles may be obtained either by pulverizing a binder resin as such and classifying the pulverized product; or by melt-kneading a composition comprising a binder resin and an additive such as the above-mentioned colorant, release agent or magnetic material, pulverizing the kneaded product, and classifying the pulverized product. On the other hand, the modifier particles can be fine powder of a charge control agent as such. Further, the modifier particles may be fine particles comprising a binder resin and the above-mentioned charge control agent, colorant or magnetic material dispersed therein; or a mixture comprising a binder and the above-mentioned charge control agent, colorant, or magnetic material attached thereto or mixed therewith. Incidentally, the modifier particles may preferably have volume-average particle size of 1/5 or below, more preferably 1/10 or below, of that of the base particles, in view of the fixing thereof to the base particles.

In the present invention, average particle size, and the particle size distribution, of the base particles, modifier particles or toner particles are measured by the following method.

Coulter Counter Model TA-II (mfd. by Coulter Electronic Inc.) or Elzone Particle Counter Model 80XY-2 (mfd. by Particle Data Inc., U.S.A.) is used as a measuring device and a number-average particle size distribution and a volume-average particle size distribution are outputted. A 1–4% aqueous NaCl solution is used as an electrolytic solution. In the measurement, 0.1–5 ml of a surfactant, as a dispersing agent, preferably of alkylbenzenesulfonate is added to 100–150 ml of the above-mentioned aqueous electrolytic solution, and further 0.5–50 mg of a sample for measurement is added to the resultant mixture and suspended. The resultant suspension of the sample in the electrolytic solution is dispersed by means of an ultrasonic dispersing device for about 1–3 min. Thereafter, the particle size distribution of particles having a particle size of 0.2–40 μm is measured by means of the above-mentioned Coulter Counter TA-II or Elzone Particle Counter 80 XY-2 with an aperture of 12–120 μm, whereby the number-average particle size distribution and the volume-average particle size distribution are determined.

In a case where a binder resin as such is used for the base particles, it is required to use, as the modifier particles, fine particles wherein an additive such as a charge control agent, a release agent or a colorant is dispersed in a binder resin. Such embodiment is effective in producing color or chromatic toners, e.g., for use in a multi-color copying machine. However, it is generally preferred to use, as the base particles, a classified product obtained by melt-kneading a binder resin and a colorant or magnetic material (and a release agent, as desired), pulverizing the kneaded product, and classifying the pulverized product. The reason for this is that free particles of these materials may impair the image quality in many cases.

In the present invention, it is rather preferred that a charge control agent is used as the modifier particles or contained in the modifier particles, in order to enhance the effect thereof. In such embodiment, a sufficient effect may surely be obtained by using a relatively small amount of the charge control agent. Accordingly, such embodiment is preferred in view of both the image quality and the production cost. It is preferred that the concentration of the charge control agent in the modifier particles is as high as possible. Further, it is preferred that the particle size of the modifier particles is as small as possible.

In a case where a resin is used as a component of the modifier particles, the resin may be the binder resin described in the case of the base particles. This resin may preferably have a glass transition temperature (Tg) of 50° C. or above, more preferably 55–100° C., in view of the anti-blocking property of the toner produced in the present invention.

In the present invention, the modifier particles (B) may preferably be used in an amount of 0.1–20 wt. parts, per 100 wt. parts of the base particles (A). The process according to the present invention may preferably be applicable to the production of a toner having a volume-average particle size of 2–25 μm.

In the toner obtained in the present invention, the modifier particles (B) are surely fixed to the base particles (A), e.g., through embedding in the base particles. Accordingly, even when the toner in the present invention is subjected to ultrasonic dispersion under the same conditions as described in the case of the measurement of a particle size distribution, the modifier particles (B) are not substantially removed from the base particles (A).

Incidentally, there are some cases wherein the amount of the triboelectric charge of a toner extraordinarily increases, e.g., under low temperature-low humidity conditions. In such case, a decrease in image density or image quality is liable to occur. In order to prevent these phenomena, it is effective that a colorant, a magnetic material or an inorganic pigment having a relatively small chargeability is added to the modifier particles.

Hereinbelow, the present invention will be described based on Examples.

EXAMPLE 1

| | |
|---|---|
| Styrene-2-ethylhexyl acrylate-divinylbenzene copolymer (copolymerization weight ratio = 80:20:1, weight-average molecular weight Mw: about 300,000, softening point = 110° C.) | 90 wt. parts |
| Polyethylene wax (Hi-wax 200P, mfd. by Mitsui Sekiyu Kagaku) | 4 wt. parts |
| Carbon black | 10 wt. parts |

A mixture having the above prescription was melt-kneaded at 150° C. for about 30 min. by means of a roll mill. The obtained kneaded product was cooled and then pulverized by means of a pulverizer equipped with a classifier for classifying coarse powder (Jet Mill I2-DS2, mfd. by Nippon Pneumatic Kogyo K.K.) into particles having a volume-average particle size of about 10 μm. Fine powder was removed from the resultant pulverized product by means of a zigzag classifier (mfd. by Alpine Co. Ltd.) thereby to obtain particles having volume-average particle size of about 10 μm. Thereafter, the particles were smoothed by means of a device as shown in FIG. 2A (distance between the tips of the opposite blades: 200 mm, width of the blade: 15 mm) for 3 min. at a peripheral speed of 130 m/sec at the tip of the blade, whereby the particles were smoothed to form the surfaces thereof into curved surfaces. The ratio of the smallest diameter to the largest diameter of the particles was 0.65–0.68 before the smoothing, but it was about 0.78 after the smoothing.

Figure 9A:
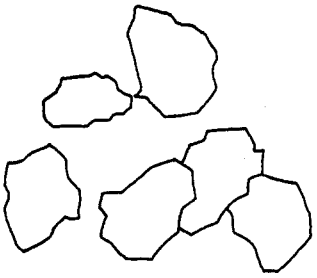
FIG. 9A is a schematic view showing pulverized particles before smoothing.
Figure 9B:
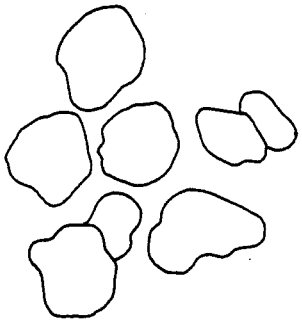
FIG. 9B is a schematic view showing smoothed particles having a curved surface.

The particles having the above ratio of 0.78 were used as base particles (A). According to an observation using an electron microscope, the particles before the smoothing had a shape as shown in FIG. 9A, and those after the smoothing had a shape as shown in FIG. 9B.

Separately, powdery modifier particles (B) were prepared in the following manner.

| | |
|---|---|
| Polystyrene (number-average molecular weight Mn = about 20,000, Tg = 90° C.) | 100 wt. parts |
| Cr complex of di-tertiary-butyl salicylic acid | 4 wt. parts |

A mixture having the above prescription was kneaded at 120° C., cooled and then coarsely pulverized by means of a coarse pulverizer (Hammer Mill Model H-8, mfd. by Hosokawa Mircon K.K.). Then, the pulverized product was further micro-pulverized by means of a pulverizer (equipped with a classifier for classifying coarse powder (Jet Mill I2-DS2, mfd. by Nippon Pneumatic Kogyo K.K.), and classified by means of a wind-force classifier, thereby to obtain modifier particles (B) having a volume-average particle size of 1 μm. The thus obtained modifier particles contained 5 wt. % of particles having a particle size of 2 μm or above.

Then, 80 wt. parts of the modifier particles (B) were uniformly dispersed in 1000 wt. parts of the above-prepared base particles (A) and attached thereto by means of a device having a 50 cm-length stirring vane (Henschel Mixer FM 75C, mfd. by Mistui-Miike Seisakusho K.K.) shown in FIG. 1 at a peripheral speed of 30 m/sec for 5 min., thereby to effect a pre-treatment.

Thereafter, the resultant mixture was further treated by means of the device shown in FIG. 2A at a peripheral speed of the blade of 80 m/sec for 5 min. thereby to obtain a toner having a volume-average particle size of about 11 μm. This peripheral speed corresponded to about 2 sec in terms of a period of time in which a particle was passed through an impact zone wherein an impact force was applied thereto.

According to an observation through an electron microscope, it was found that the modifier particles were fixed to the base particles. Further, it was considered that the resultant toner particle comprised the colored base particle (A) 61 and the modifier particle (B) 62 as shown in FIG. 8.

Incidentally, in order to make a comparison, the base particles (A) and the modifier particles (B) were simply mixed to prepare mixed powder, which was then observed through an electron microscope. As a result, it was found that the thus prepared mixed powder had a different appearance from the above-mentioned toner particles obtained in the present invention. Further, when this mixed powder was dispersed in water containing a surfactant by means of an ultrasonic dispersing device under the same conditions as described in the case of the measurement of a particle size distribution, the modifier particles (B) were removed from the base particles (A). On the contrary, in the toner obtained in the present invention, the modifier particles (B) fixed to the base particles (A) were not substantially removed from the base particles (A), even after the toner was subjected to ultrasonic dispersion under the same conditions as described above.

Figure 10:
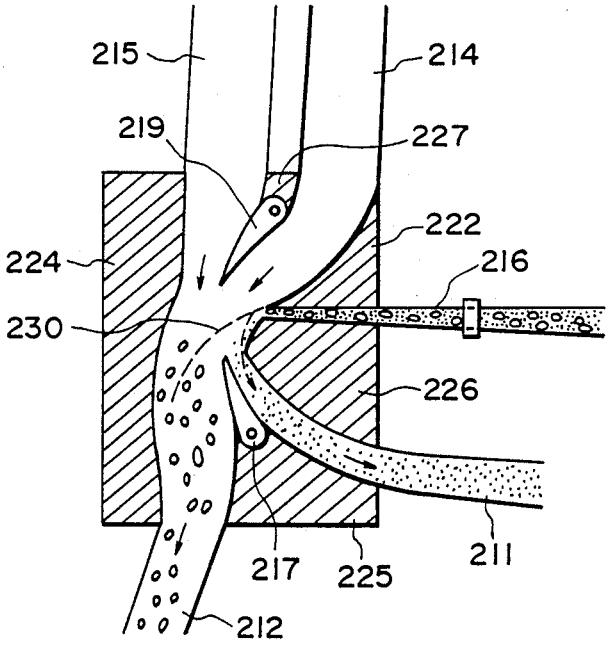
FIG. 10 is a schematic sectional view showing a classifier utilizing a Coanda effect.

The thus prepared toner particles were classified by means of a classifier utilizing a Coanda effect as shown in FIG. 10 to remove ultrafine powder whereby a classified toner was obtained.

Incidentally, in a multi-division classifier utilizing a Coanda effect as shown in FIG. 10 comprises exhaust pipes 211 and 212, gas-intake pipes 214 and 215, a powder supply nozzle 216, a classifying wedge 217, a gas-intake wedge 219, side walls 222 and 224, a lower wall 225, a Coanda block 226, and an upper wall 227. Further, an arrow 230 denotes a moving direction of solid particles.

To 100 wt. parts of the resultant classified product (toner) 0.5 part of colloidal silica (trade name R-972, by Nihon Aerosil K.K.) was extremely added.

Separately, 100 parts of ferrite particles having a particle size of 250–300 mesh was coated with 0.8 part of a silicone resin thereby to prepare magnetic particles (carrier). 100 wt. parts of the magnetic particles and 10 wt. parts of the above-prepared toner were mixed thereby to prepare a developer.

Figure 5:
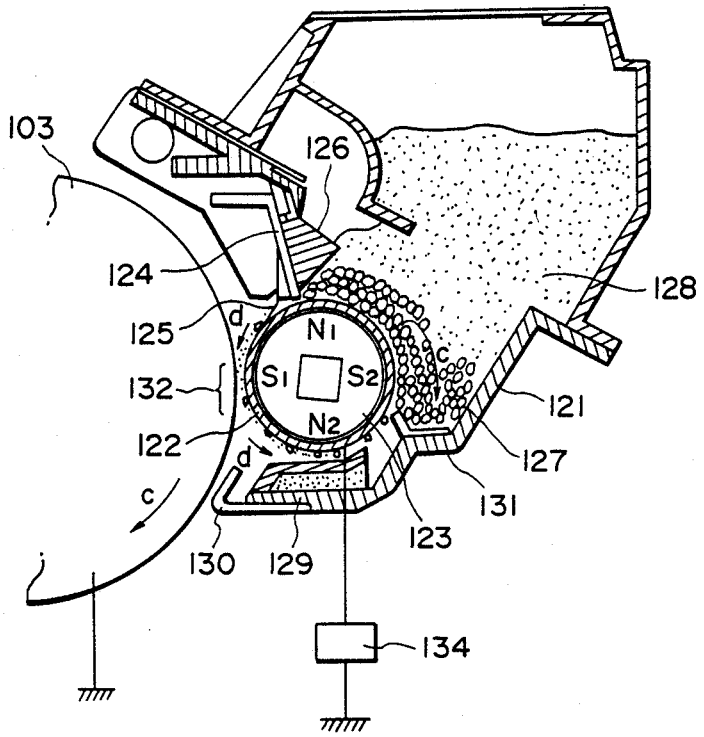
FIG. 5 is a schematic sectional view showing an image-forming device for effecting image formation by using a toner obtained in the present invention.

The thus prepared developer was charged into a developing device as shown in FIG. 5 and subjected to development, whereby a good image having an image density of 1.31 was obtained.

In this development, a developing apparatus as shown in FIG. 5 was used.

Figure 6:
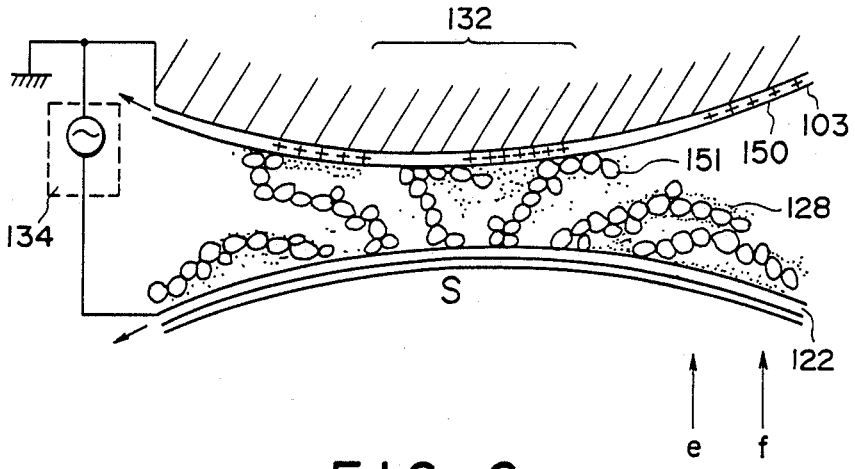
FIGS. 6 and 7 are enlarged schematic sectional views each showing a developing zone in the image-forming device shown in FIG. 5.
Figure 7:
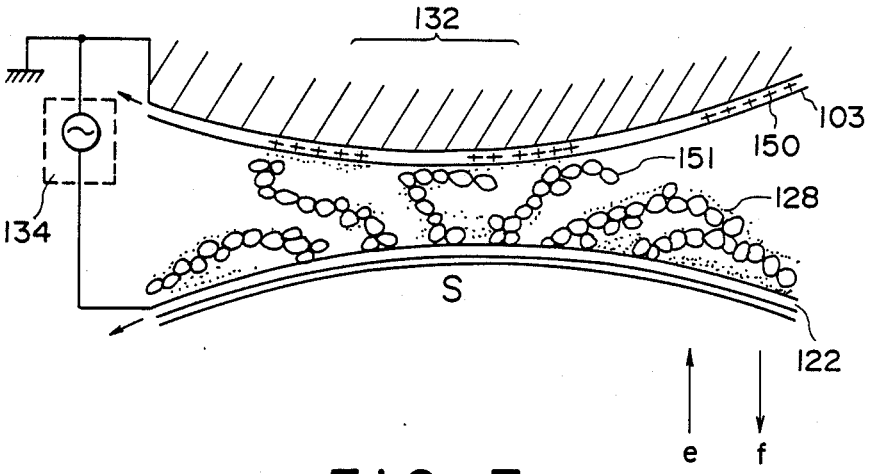

Incidentally, the developing apparatus shown in FIG. 5 comprises a photosensitive drum 103, a developer container 121, a non-magnetic sleeve 122, a fixed magnet 123, a nonmagnetic blade 124, a member 126 for limiting a circulation region for magnetic particles, a container portion 129 for collecting a developer, a member 130 for preventing a scattering, a magnetic member 131, and a bias power supply 134. In FIG. 5, a reference numeral 127 denotes magnetic particles (carrier), numeral 128 denotes a nonmagnetic toner, and numeral 132 denotes a developing zone. Further, FIG. 6 and FIG. 7 are enlarged views of the developing zone of the apparatus shown in FIG. 5. In FIGS. 6 and 7, an arrow e denotes the direction of the electric field based on a DC bias component, and an arrow f denotes that based on an AC bias component.

Referring to FIG. 5, the photosensitive drum 103 rotates in the direction of an arrow c, at a peripheral speed of 60 mm/sec, and the sleeve 122 comprised a hollow cylinder of stainless steel (SUS 304) having an outside diameter of 32 mm and a thickness of 0.8 mm, and rotated in the direction of an arrow d at a peripheral speed of 66 mm/sec. The surface of the sleeve had been subjected to a irregular-shape sandblasting by using an Alundum abrasive (#600).

On the other hand, the fixed magnet 123 of a ferrite-sinter type having poles of $N_1$, $N_2$, $S_1$ and $S_2$ was disposed in the rotating sleeve 122. Thus, a maximum magnetic flux density of above 800 Gauss was exerted to the surface of the sleeve (developer-carrying member). The nonmagnetic blade 124 comprised nonmagnetic stainless steel and had a thickness of 1.2 mm. The blade 124 and the sleeve 122 were disposed at a gap of 400 μm. The sleeve 122 and the photosensitive drum 103 were disposed opposite to each other at a gap of 300 μm.

On the surface of the photosensitive drum 103, an electrostatic latent image 150 of a charge pattern comprising a dark portion of +600 V and a bright portion of +150 V was formed. A bias voltage having a frequency of 800 Hz, a peak-to-peak value of 1.4 KV and a central value of +300 V was applied to the sleeve 122 by means of the powder supply 134. Thus, as shown in FIG. 6, the electrostatic image formed on the photosensitive drum was developed by using a magnetic brush 151.

EXAMPLE 2 AND COMPARATIVE EXAMPLE 1

Figure 11:
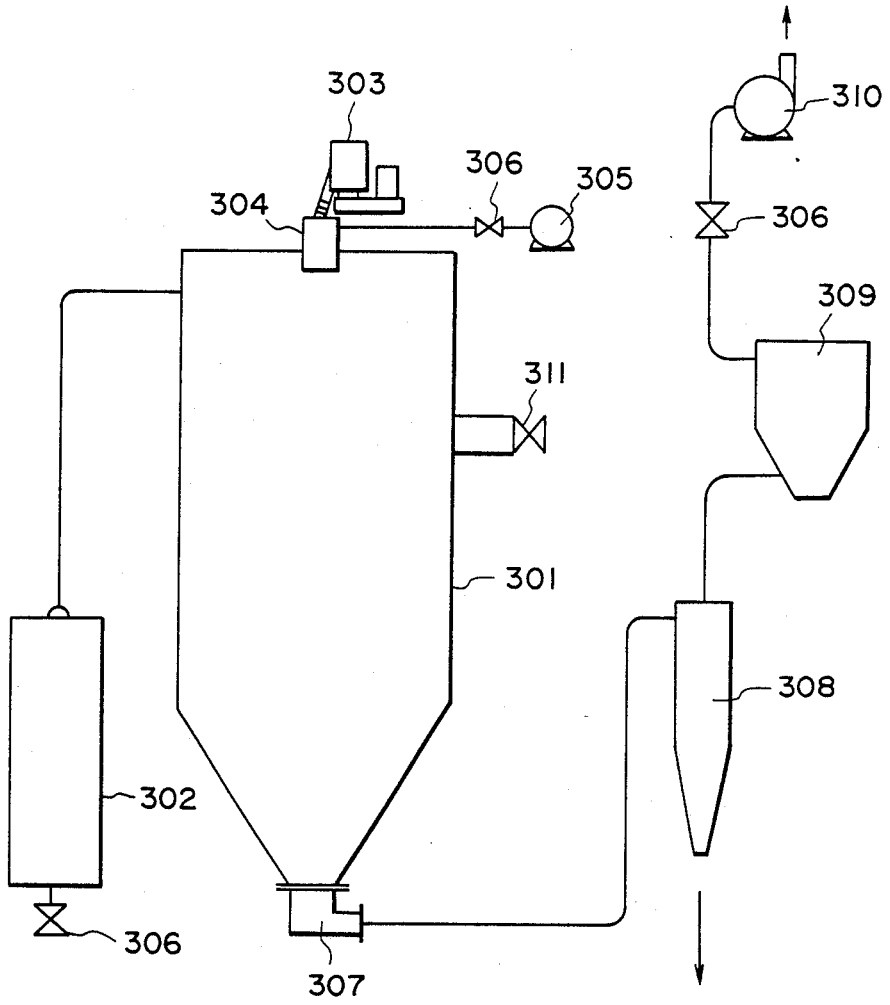
FIG. 11 is a schematic view illustrating an embodiment of a device for spheriodizing particles by heating.

Classified particles having a volume-average particle size of 10μ and having a ratio of the smallest diameter to the largest diameter of 0.65–0.68 were prepared in the same manner as in Example 1. The thus prepared particles were then heated-treated by means of a heat-treating device as shown in FIG. 11, thereby to prepare two species of smoothed base particles, i.e., particles ($A_1$) having a ratio of the smallest diameter of the largest diameter of 0.86, and particles ($A_2$) having the ratio of 0.94.

Incidentally, the device system for heat-treating the base particles comprises a heat-treating device 301, a hot blast stove 302, a material supply feeder 303, a material powder-dispersing pipe 304, a block 305 for air for dispersing the material, an air damper 306, a discharge port 307 of the heat-treating device, a cyclone 308 for collecting a treated product, a bug filter 309, an exhaust blower 310, and a cold blast-intake part.

The base particles ($A_1$) were used in Example 2, and the base particles ($A_2$) were used in Comparative Example 1.

In Example 2, the modifier particles (B) used in Example 1 were attached and fixed to the base particles ($A_1$) in the same manner as in Example 1, thereby to obtain a toner. The thus prepared toner was then classified, mixed with colloidal and mixed with magnetic particles in the same manner as in Example 4 thereby to prepare a developer, which was then subjected to image formation the same as in Example 1. In case of the thus prepared developer of Example 2 in which the base particles ($A_1$) were used, good images were obtained. Further, the fixability, the anti-offset characteristic and the anti-winding characteristics were also good.

On the other hand, in Comparative Example 1, the modifier particles (B) used in Example 1 were attached and fixed to the base particles ($A_2$) having a ratio of the smallest diameter to the largest diameter of 0.94 in the same manner as in Example 1, thereby to obtain a toner. The thus prepared toner was then subjected to the same treatments as described above thereby to prepare a developer, which was then subjected to image formation the same as in Example 1. In case of the thus prepared developer of Comparative Example 1 in which the base particles ($A_2$) were used, in successive copying test, the cleaning of the toner on the drum was somewhat deteriorated and a cleaning failure was liable to occur, at the time of copying of 200–300 sheets or more.

As described above, the base particles $A_1$ having a ratio of the smallest diameter to the largest diameter of 0.86 was more advantageous in the cleaning characteristics than the pearl-like base particles $A_2$ having the ratio of above 0.9.

EXAMPLE 3

Base particles (A) and modifier particles (B) were prepared; and the modifier particles (B) were fixed to the base particles (A) in the same manner as in Example 1 thereby to prepare a toner. Then, unlike Example 1, without the removal of fine powder by classification, 0.5 wt. part of colloidal silica R-972 was externally added to the thus prepared toner in the same manner as in Example 1. Further, the resultant mixture was subjected to the same treatment as in Example 1, thereby to prepare a developer, which was then subjected to image formation the same as in Example 1. As a result, good images were obtained. However, the image density measured by means of a Macbeth densitometer was 0.05–0.10 lower than that in Example 1, and the resolution was also somewhat low as compared with that in Example 1.

EXAMPLE 4

| | |
|---|---|
| Styrene-butyl acrylate-divinylbenzene copolymer (copolymerization weight ratio = 80:20:1, weight-average molecular weight Mw = about 300,000, softening point = 110° C.) | 90 wt. parts |
| Polyethylene wax (Hi-Wax 200P, mfd. by Mitsui Sekiyu Kagaku) | 4 wt. parts |
| Magnetic powder (specific surface area: 8 $m^2/g$) | 60 wt. parts |

A mixture having the above prescription was melt-kneaded at 150° C. for about 30 min by means of a roll mill. The obtained kneaded product was cooled and then pulverized by means of a pulverizer into particles having a volume-average particle size of about 9 μm. Fine powder was removed from the pulverized product by means of a zigzag classifier (mfd. by Alpine Co.) thereby to obtain particles having a volume-average particle size of about 10 μm. Thereafter, the particles were smoothed in the same manner as in Example 1 thereby to prepare base particles (A).

Separately, modifier particles (B) were prepared in the following manner.

| | |
|---|---|
| Polystyrene (number-average molecular weight Mn = about 20,000) | 100 wt. parts |
| Nigrosine (mfd. by Orient Kagaku K.K.) | 2 wt. parts |

A mixture having the above prescription was kneaded, cooled, pulverized and classified thereby to obtain modifier particles (B) having a volume-average particle size of 1 μm.

Then, 40 wt. parts of the modifier particles (B) were uniformly dispersed in 1000 wt. parts of the above-prepared base particles (A) and fixed thereto, thereby to prepare a magnetic toner having a volume-average particle size of 11 μm. According to an observation of the magnetic toner through an electron microscope, it was found that the modifier particles were fixed to the base particles.

To 100 wt. parts of this magnetic toner 0.5 part of colloidal silica treated with an amino-silicone oil was externally added thereby to prepare a developer, which was then subjected to image formation by means of a copying machine NP-3525 (mfd. by Canon K.K.)

A successive copying test of 10,000 sheets was conducted under normal temperature-normal humidity (25° C., 60% RH) conditions and under low temperature-low humidity (15° C., 10% RH) conditions. In both sets of conditions, good images having an image density of 1.3, with little fog and no image flow were obtained.

After the successive image formation, toner particles were removed from a part of the surface of the developer-carrying member (sleeve) in the copying machine by attaching an adhesive tape to the part twice. Further, an adhesive tape was attached to the resultant exposed surface part of the developer-carrying member, and then peeled therefrom. The resultant adhesive surface of the thus obtained three kinds of the adhesive tapes were respectively observed by mans of an electron microscope, whereby it was found that substantially no free modifier particles (B) were present on each of the three kinds of the adhesive tapes.

EXAMPLE 5

| | |
|---|---|
| Styrene-butyl acrylate-divinylbenzene copolymer (weight-average molecular weight Mw: about 300.000) | 90 wt. parts |
| Polyethylene wax (Hi-Wax 200P, mfd. by Mitsui Sekiyu Kagaku) | 4 wt. parts |
| Magnetic powder (BET specific surface area: 8 $m^2/g$) | 60 wt. parts |

A mixture having the above prescription was melt-kneaded at 150° C. for about 30 min by means of a roll mill. The obtained kneaded product was cooled and then pulverized by means of a mechanical pulverizer (Turbo Mill, mfd. by Turbo Kogyo K.K.) into particles having a volume-average particle size of about 9 μm. Fine powder was removed from the pulverized product by means of a zigzag classifier (mfd. by Alpine Co.) thereby to obtain particles (A) having a volume-average particle size of about 10 μm.

In the above mechanical pulverization for preparing the base particles (A), the peripheral speed of a pulverizing rotor was set to 160 m/sec and the clearance between the rotor and a liner was set to 1 mm, whereby the particles were smoothed simultaneously with the pulverization thereof to the particle size corresponding to that of a toner. The thus obtained base particles (A) had a ratio of the smallest diameter the largest diameter of 0.80.

In this instance, a powdery chromium complex of di-tertiary-butyl salicylic acid having an average particle size of 1 μm was used as modifier particles (B) as such.

2 wt. parts of the modifier particles (B) were uniformly dispersed in 1000 wt. parts of the above-prepared base particles (A) and attached thereto by means of a device shown in FIG. 1 at a peripheral speed of the stirring vane of 30 m/sec for 5 min., thereby to effect a pretreatment.

Thereafter, the resultant mixture was further treated by means of a device shown in FIG. 2A at a peripheral speed of the blade of 80 m/sec for 5 min to effect fixing thereby to prepare a toner. This peripheral speed corresponding to about 2 sec in terms of a period of time in which the particle was passed through an impact zone wherein an impact force was applied thereto.

To 100 wt. parts of this toner 0.5 wt. part of hydrophobic silica (Tullanox-500, mfd. by Tulco Co. Ltd.) was externally added thereby to prepare a developer, which was then subjected to image formation by means of a copying machine NP-7550 (mfd. by Canon K.K.).

A successive copying test of 10,000 sheets was conducted under normal temperature-normal humidity conditions and under low temperature-low humidity conditions. In both sets of conditions, clear good images having an image density (measured by a Macbeth densitometer) of 1.4–1.5 in the solid image portion without fog.

After the successive copying, toner particles were removed from a part of the surface of the developer-carrying member (sleeve) in the copying machine by attaching an adhesive tape to the part twice. Further, an adhesive tape was attached to the resultant exposed surface part of the developer-carrying member, and then peeled therefrom. The resultant adhesive surface of the thus obtained three kinds of the adhesive tapes were respectively observed by means of an electron microscope, whereby it was found that substantially no free modifier particles (B) were present on each of the three kinds of the adhesive tapes.

COMPARATIVE EXAMPLE 2

| | |
|---|---|
| Styrene-butyl acrylate-divinylbenzene copolymer (weight-average molecular weight Mw: about 300,000) | 90 wt. parts |
| Cr complex of di-tertiary-butyl salicylic acid | 0.3 wt. part (about 0.2 wt. %) |
| Polyethylene wax (Hi-Wax 200P, mfd. by Mitsui Sekiyu Kagaku) | 4 wt. parts |
| Magnetic powder (specific surface area: 8 $m^2/g$) | 60 wt. parts |

A mixture having the above prescription was melt-kneaded at 150° C. for about 30 min by means of a roll mill. The obtained kneaded product was cooled and then pulverized using a pulverizer into particles having a volume-average particle size of about 9 μm. Fine powder was removed from the pulverized product by means of a zigzag classifier (mfd. by Alpine Co.) thereby to obtain toner having a volume-average particle size of about 10 μm.

To 100 wt. parts of the toner 0.5 wt. part of hydrophobic silica (R-972) was externally added thereby to prepare a developer, which was then subjected to image formation by means of a copying machine NP-7550 (mfd. by Canon K.K.).

A successive copying test of 10,000 sheets was conducted under normal temperature-normal humidity conditions and under low temperature-low humidity conditions (15° C., 10% RH). In both environmental conditions, the initial images were observed, whereby the obtained images showed a low image density (measured by a Macbeth densitometer) of 0.6–0.8.

COMPARATIVE EXAMPLE 3

Pulverized base particles (A) having a volume-average particle size of 10 μm were prepared in the same manner as in Example 1. Thereafter, without a smoothing treatment, modifier particles (B) were fixed to the base particles (A) in the same manner as in Example 1 thereby to prepare a toner.

According to observation through an electron microscope, it was found that some toner particles having crushed protrusions were present, and that in such toner particles, the surfaces of the base particles were unevenly exposed as compared with the toner according to the present invention.

A developer comprising the above-mentioned toner was then subjected to image formation and fixing test in the same manner as in Example 1. As a result, good images were obtained but the image density measured by means of a Macbeth densitometer was about 0.10 lower than that in Example 1, and fog was somewhat noticeable as compared with that in Example 1.

What is claimed is:

1. A process for producing a toner for developing an electrostatic latent image comprising the steps of:

pulverizing a resinous material comprising a binder resin using micro-pulverizing means to prepare resinous particles;

classifying the resinous particles using classifying means to obtain classified particles having a predetermined particle size;

removing surface inequalities of irregularities of the classified particles to yield smoothed base particles (A) having a ratio of the smallest diameter to the largest diameter thereof of 0.70–0.90;

mixing the base particles (A) with modifier particles (B), thereby to attach the modifier particles (B) to the surfaces of the base particles (A); and using a mechanical impact force to fix modifier particles (B) to the surfaces of the base particles (A).

2. A process according to claim 1, wherein the base particles (A) are prepared by smoothing the classified particles having a ratio of the smallest diameter to the largest diameter of below 0.70.

3. A process according to claim 2, wherein the base particles (A) have a ratio of the smallest diameter to the largest diameter of 0.75–0.90.

4. A process according to claim 1, wherein the classified particles are smoothed by an impact-type pulverizing means.

5. A process according to claim 1, wherein the modifier particles (B) are fixed to the surfaces of the base particles (A) by passing them through an impact zone having a minimum clearance of 0.5–5 mm between a rotating member and a fixed member or between at least two rotating members, at an ambient temperature of 10–100° C. under the action of the impact force exerted in said impact zone.

6. A process according to claim 5, wherein the rotating member rotates so that the tip thereof forming the minimum clearance has a peripheral speed of 30–150 m/sec.

7. A process according to claim 6, wherein the rotating member rotates so that the tip thereof has a peripheral speed of 30–130 m/sec.

8. A process according to claim 7, wherein the rotating member rotates so that the tip thereof has a peripheral speed of 30–100 m/sec.

9. A process according to claim 5, wherein the modifier particles (B) are fixed to the surfaces of the base particles (A) at a temperature of 20°–100° C.

10. A process according to claim 9, wherein the modifier particles (B) are fixed to the surfaces of the base particles (A) at a temperature of 30–70° C.

11. A process according to claim 5, wherein the base particles (A) and the modifier particles (B) are introduced into the impact zone so that the total residence time therein is 0.2–12 sec.

12. A process according to claim 11, wherein the base particles (A) and the modifier particles (B) are recycled so that they pass through the impact zone plural times.

13. A process according to claim 1, wherein the base particles (A) have a volume-average particle size of 2–20μ.

14. A process according to claim 1, wherein the modifier particles (B) have a volume-average particle size of 1/5 or less that of the base particles (A).

15. A process according to claim 1, wherein the base particles (A) are mixed with the modifier particles (B) at a temperature of 0°–50° C. for 10 sec.–24 hours by means of a mixer having a stirring vane, before fixing.

16. A process according to claim 15, wherein the base particles (A) are mixed with the modifier particles (B) at a temperature of 0°–50° C. for 1 min–60 min by means of a mixer having a stirring vane, before fixing.

17. A process according to claim 1, wherein the base particles (A) comprise a binder resin having a softening point of 90°–150° C.

18. A process according to claim 17, wherein the base particles (A) comprise a binder resin of a crosslinked styrene-type copolymer.

19. A process according to claim 17, wherein the base particles (A) comprise a binder resin of a polyester resin.

20. A process according to claim 1, wherein the base particles (A) to which the modifier particles are fixed are classified by a classifying means.

* * * * *